US008267274B2

(12) United States Patent
Danks et al.

(10) Patent No.: US 8,267,274 B2
(45) Date of Patent: Sep. 18, 2012

(54) CLOSURE HAVING A DRIP MINIMIZING LID

(75) Inventors: Christopher A. Danks, Waukesha, WI (US); John Wisniewski, Waukesha, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 1028 days.

(21) Appl. No.: 12/079,533

(22) Filed: Mar. 27, 2008

(65) Prior Publication Data

US 2009/0242564 A1 Oct. 1, 2009

(51) Int. Cl.

| | |
|---|---|
| ***B65D 51/16*** | (2006.01) |
| ***B65D 51/04*** | (2006.01) |
| ***B65D 53/00*** | (2006.01) |
| ***B65D 43/04*** | (2006.01) |
| ***B65D 47/08*** | (2006.01) |
| ***B67D 1/16*** | (2006.01) |

(52) U.S. Cl. ..... 220/361; 220/839; 215/235; 215/341; 215/DIG. 1; 222/562; 222/563; 222/556; 222/566; 222/571; 222/108

(58) Field of Classification Search ..... 215/235, 215/341, DIG. 1; 220/255, 256.1, 810, 837, 220/839, 361; 222/556, 562, 563, 571, 546, 222/108–111

See application file for complete search history.

(56) References Cited

U.S. PATENT DOCUMENTS

| | | | | |
|---|---|---|---|---|
| 4,387,819 | A * | 6/1983 | Corsette | 215/273 |
| 5,143,234 | A | 9/1992 | Lohrman et al. | |
| 5,794,299 | A | 8/1998 | Gockel et al. | |
| 6,338,414 | B1 | 9/1999 | Schellenbach | |
| 6,367,670 | B1 | 4/2002 | Warner et al. | |
| 6,405,885 | B1 | 6/2002 | Elliott | |
| 6,935,543 | B2 * | 8/2005 | DeGroot et al. | 222/556 |
| 2009/0101646 | A1 * | 4/2009 | Paul et al. | 220/254.4 |

FOREIGN PATENT DOCUMENTS

| | | |
|---|---|---|
| CH | 619 413 | 9/1980 |
| DE | 8325565 U1 | 8/1984 |
| WO | WO 02/18222 | 3/2002 |

OTHER PUBLICATIONS

"International Search Report and the Written Opinion of the International Searching Authority, or the Declaration" with a completion date of Apr. 22, 2009 and a date of mailing of May 4, 2009 for PCT/US2009/001492.

Communication dated Feb. 2, 2011 received from the European Patent Office enclosing the extended European Search Report for the European application No. 09726357.8-1261.

Prior art product Drawing Sheets I, II, and III containing Figs. A, B, C, and D.

* cited by examiner

*Primary Examiner* — Robin Hylton

(74) *Attorney, Agent, or Firm* — Wood, Phillips, Katz, Clark & Mortimer

(57) ABSTRACT

A dispensing closure system is provided for a container that has an opening to the container interior. The preferred embodiment of the system includes a closure having a closure body for extending from the container at the container opening and a lid hingedly attached to the closure body. The closure body has a dispensing spout, and the lid includes a hollow spud for entering the spout. A spud rim can be provided on the spud, extending inwardly towards the hollow interior of the spud. A lid rim can additionally or alternatively be provided on the inside surface of the lid, positioned within the hollow interior of the spud.

6 Claims, 6 Drawing Sheets

CLOSURE HAVING A DRIP MINIMIZING LID

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a closure for a container.

BACKGROUND OF THE INVENTION AND TECHNICAL PROBLEMS POSED BY THE PRIOR ART

There are a variety of types of conventional closures for containers. One type of prior art closure includes a body for being attached to the top of a container. The closure body, which may be alternatively described as the closure base or base portion, covers the opening at the top of the container and typically defines a smaller dispensing passage in communication with the container interior. The closure further includes a lid which is typically hingedly mounted on the closure body and which can be lifted up to expose the dispensing passage in the closure body.

For some types of products, such as liquids, it is desirable to provide a closure that, when closed, permits the container to be shaken, and that when opened, accommodates easy dispensing of the liquid product from the container, and that subsequently accommodates proper and easy closing of the lid.

The inventors of the present invention have discovered how to provide such a closure wherein the closure includes novel, advantageous features not heretofore taught or contemplated by the prior art.

BRIEF SUMMARY OF THE INVENTION

According to the present invention, an improved dispensing closure system is provided. In the preferred embodiment, the closure system is provided in the form of a dispensing closure for a container that has an opening to the container interior where a product may be stored. The dispensing closure has a body that extends from an opening in the container. The body includes a spout, which forms a dispensing passage through which materials stored within the container can pass. The closure also includes a lid, which can be moved between a closed position, which occludes the spout dispensing package, and an open position, which exposes the spout dispensing passage. The lid has a spud, which enters the spout dispensing passage when the lid is in the closed position. The spud has a hollow interior.

The closure lid further includes a rim proximate the spud. The rim extends laterally toward, and is exposed to, the hollow interior of the spud. A spud rim can be provided, which extends from the spud toward the hollow interior of the spud. Additionally or alternatively, a lid rim can be provided within the hollow interior of the spud, extending laterally toward the center of the hollow interior of the spud.

In some embodiments, the closure can be designed for easily accommodating molding of the closure, such as molding using efficient, high quality, large volume molding techniques with a reduced product reject rate. Embodiments of the closure can also be designed to accommodate its use with a variety of conventional or special containers having a variety of conventional or special container finishes, including conventional threaded or snap-fit attachment configurations.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, the accompanying drawings disclose only one specific form as an example of the invention, and this specification describes various modifications of the specific illustrated form. However, the invention is not intended to be limited to the embodiments so described. The scope of the invention is pointed out in the appended claims.

For ease of description, many of the figures illustrating the invention show a dispensing closure system in one preferred form of a separate dispensing closure in the typical orientation that the closure has when installed on the top of a container when the container is stored upright on its base, and terms such as upper, lower, horizontal, etc., are used with reference to this orientation. It will be understood, however, that the closure system of this invention may be manufactured, stored, transported, used, and sold in an orientation other than the orientation described.

The dispensing closure system of this invention is suitable for use with a variety of conventional or special fluent substance dispensing systems, including packages, articles, and other dispensing equipment or apparatus, the details of which, although not fully illustrated or described, would be apparent to those having skill in the art and an understanding of such fluent substance dispensing systems. Such a fluent substance dispensing system, or portion thereof, with which the inventive dispensing closure system cooperates is hereinafter simply referred to as a "container." The particular container, per se, that is illustrated and described herein forms no part of, and therefore is not intended to limit, the broad aspects of the present invention. It will also be understood by those of ordinary skill that novel and non-obvious inventive aspects are embodied in the described exemplary dispensing closure system alone.

Figure 1:
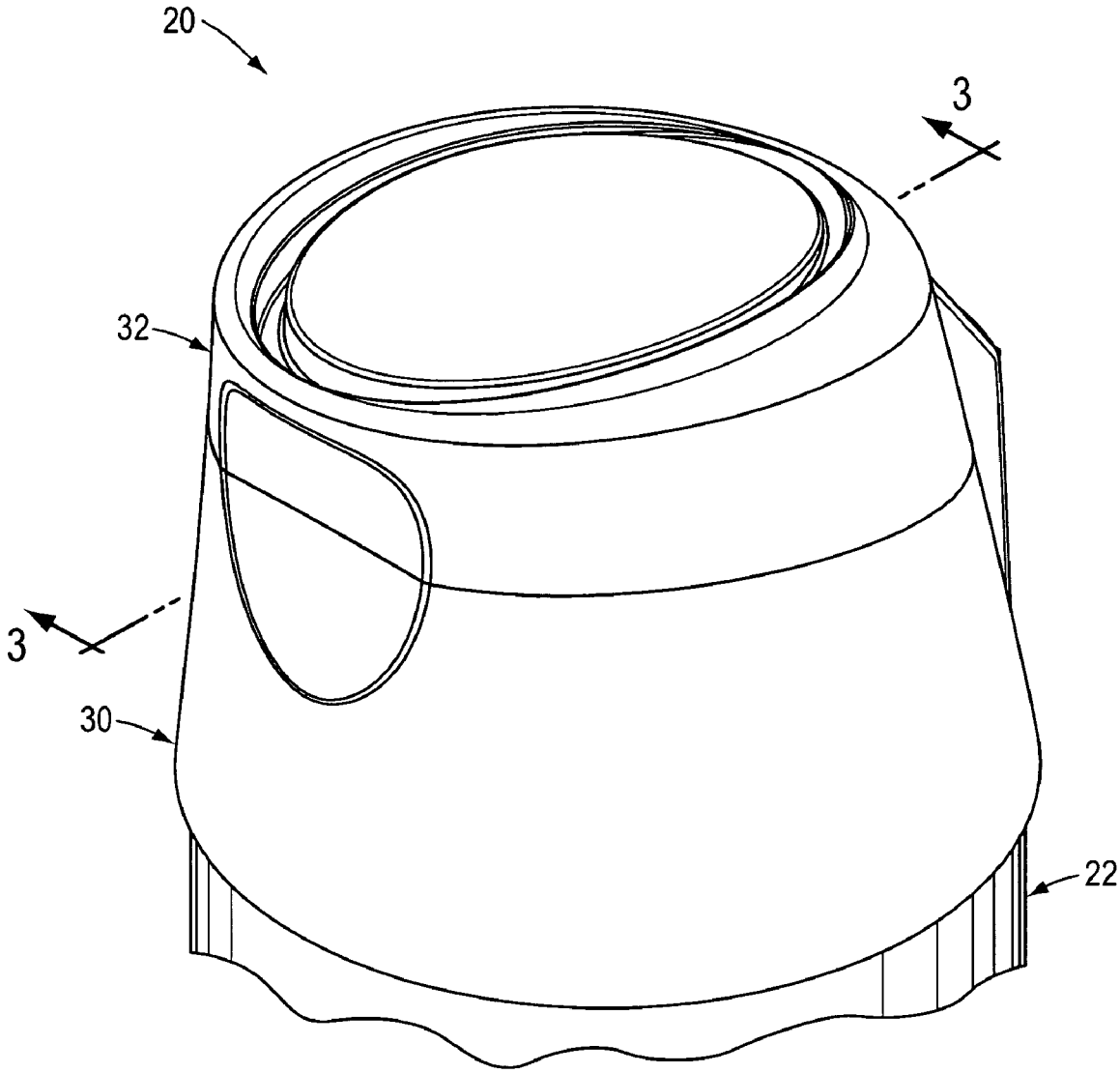
FIG. 1 is a fragmentary, isometric view of a package comprising a presently preferred embodiment of a closure of the present invention shown in a closed condition as initially manufactured and subsequently installed on a container in which a product is stored.

A presently preferred embodiment of a dispensing closure system of the present invention is illustrated in the figures and is designated generally in many of those figures by reference number 20 (e.g., in FIG. 1). In the preferred embodiment illustrated, the closure system 20 is provided in the form of a separate dispensing closure 20 which is adapted to be mounted or installed on a container 22 (see, for example, FIGS. 1 and 3), and the container 22 would typically contain a product in the form of a fluent substance.

Figure 3:
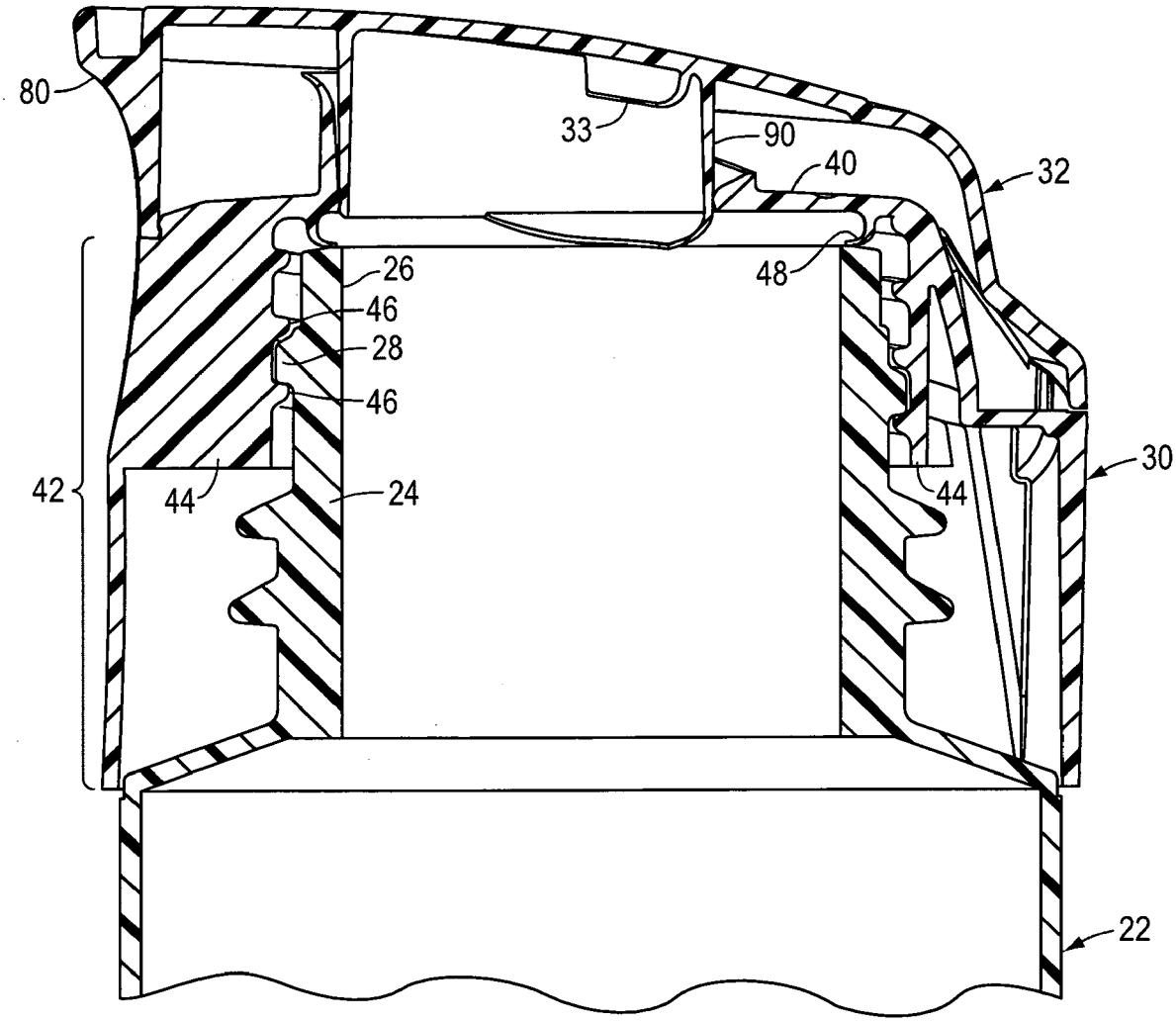
FIG. 3 is a fragmentary, cross-sectional view taken generally along the plane 3-3 in FIG. 1.

As can be seen in FIG. 3, the container 22 includes a neck 24 which extends upwardly from the hollow body portion of the container 22. The neck 24 defines a mouth on opening 26 to the container interior and product contained therein.

The container neck 24, in the preferred embodiment illustrated in FIG. 3, has an external, male thread 28 for engaging the dispensing closure system 20. In one presently preferred embodiment (as illustrated), the closure 20 is adapted to be threadingly, and removably, attached to the top of the container 22.

The body of the container 22 may have any suitable configuration, and the upwardly projecting neck 24 may have a different cross-sectional size and/or shape than the container body. (Alternatively, the container 22 need not have a projecting neck 24, per se. Instead, the container 22 may have other configurations, such as a hollow body with an opening.)

Although the container 22, per se, does not necessarily form a part of the present invention, per se, it will be appreciated that at least a portion of the dispensing closure system 20 of the present invention optionally may be provided as a unitary portion, or extension, of the top of the container 22. However, in the preferred embodiment illustrated, the dispensing closure system 20 is a completely separate article or unit (e.g., a dispensing closure 20) which can comprise either one piece or multiple pieces, and which is adapted to be removably, or non-removably, installed either on a previously manufactured container 22 that has an opening 26 to the container interior or that can be installed on a "container" portion of some other fluent substance handling system (e.g., machine, apparatus, etc.). Hereinafter, the dispensing closure system or dispensing closure 20 will be more simply referred to as the "closure 20."

The illustrated, preferred embodiment of the closure 20 is adapted to be used with the container 22 having the opening 26 to provide access to the container interior and to a product (e.g., a material in the form of a fluent substance) contained therein. The closure 20 can be used to dispense various substances, including, but not limited to, liquids, suspensions, mixtures, etc. (such as, for example, fluent food products (e.g., a liquid dairy creamer or non-dairy creamer), a personal care product, an industrial or household cleaning product, or other compositions of matter (e.g., compositions for use in activities involving manufacturing, commercial or household maintenance, construction, agriculture, medical treatment, military operations, etc.)).

The container 22 with which the closure 20 may be used may be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape.

Such a squeezable container is preferred in many applications but may not be necessary or preferred in other applications. For example, in some applications it may be desirable to employ a generally rigid container. In some applications, it may even be desirable to pressurize the interior of such a rigid container at selected times with a piston or other pressurizing system (not illustrated), or to reduce the exterior ambient pressure around the exterior of the closure, so as to cause the product to be forced out through the open closure or so as to otherwise assist in the dispensing of the product through the open closure.

In one application for which the invention is well suited, the container can be substantially rigid, especially where the product is a low viscosity liquid that can be readily dispensed by inverting the container and then pouring the liquid through the opened closure.

Figure 2:
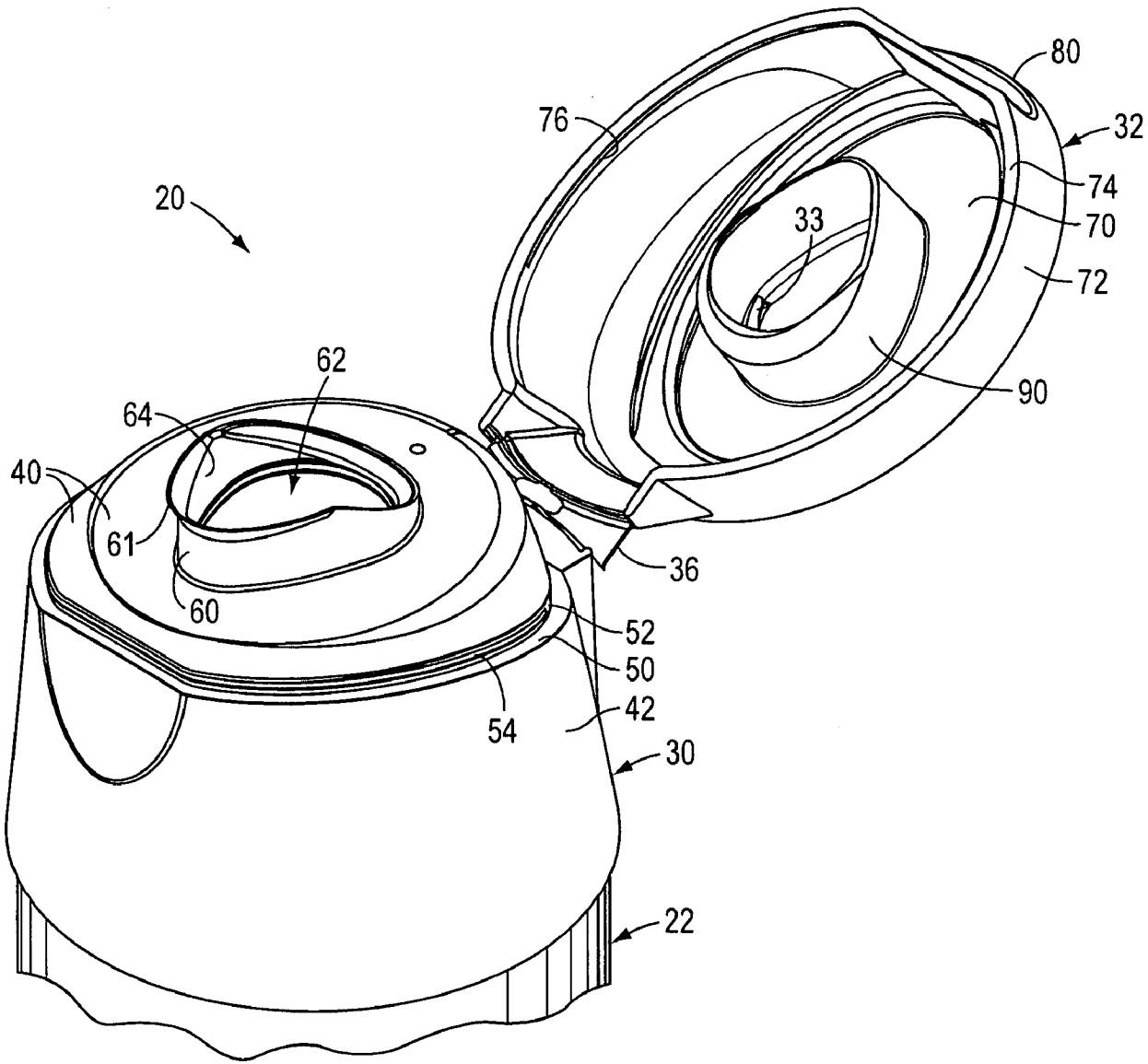
FIG. 2 is a fragmentary, isometric view of the closure and container shown in FIG. 1, but in FIG. 2 the closure lid has been opened to expose the inside of the closure lid and the top of the closure body.

As seen in FIG. 2, the preferred structure of the closure 20 comprises a body 30 (which may be characterized as defining a peripheral wall, base, or other analogous structure at the top of the container) and a lid 32 (i.e., top or cover) joined to the body 30 by a hinge 36. In the preferred embodiment illustrated, the closure body 30, lid 32, and hinge 36 are molded together as a unitary structure from a suitable thermoplastic material such as polypropylene or the like. Other materials may be employed instead. In the illustrated embodiment, the closure 20 is initially molded as a completely separate article that is subsequently attached to the container 22 after the container 22 has been initially filled with a product.

As can be seen in FIG. 2, the closure body 30 includes an upper portion or deck 40. As can be seen in FIG. 3, the body 30 has a lower portion 42 which extends downwardly from the periphery of the deck 40 and which includes an internal structure 44 for engaging the container neck 24 when the closure body 30 is mounted on the container 22. As can also be seen in FIG. 3, the internal structure 44 of the closure body 30 defines an internal, female thread 46 for threadingly engaging the container neck external, male thread 28 when the dispensing closure body 30 is installed on the container neck 24.

Alternatively, the closure body lower portion 42 could be provided with some other container connecting means, such as a snap-fit bead or groove (not illustrated) for engaging a container neck groove or bead (not illustrated), respectively. Also, the closure body lower portion 42 could instead be permanently attached to the container 22 by means of induction melting, ultrasonic melting, gluing, or the like, depending on materials used for the closure body lower portion 42 and container 22. In another alternate design (not illustrated), the closure body lower portion 42 could be formed (e.g., molded) as a unitary extension, or part, of the container 22.

The closure body lower portion 42 may have any suitable configuration for accommodating an upwardly projecting neck 24 of the container 22 or for accommodating any other portion of a container received within the particular configuration of the closure body lower portion 42—even if a container does not have a neck, per se. The main part of the container 22 may have a different cross-sectional shape than the container neck 24 and closure body lower portion 42. The closure body lower portion 42 may be adapted for mounting to other types of fluent substance handling container systems (e.g., including dispensing apparatus, machines, or equipment).

In the illustrated embodiment of the invention, the container neck-receiving opening defined by the closure body internal structure 44 has a generally cylindrical configuration and includes the thread 46 that projects laterally inwardly. However, the closure body internal structure 44 may have other configurations. For example, the closure body internal structure 44 might have a prism or polygon configuration adapted to be mounted to the top of a container neck having a polygon configuration. Such prism or polygon configurations might not accommodate a threaded attachment, but other means of attachment could be provided, such as a snap-fit bead and groove arrangement, adhesive, or the like.

As can be seen in FIG. 3, a type of "crab's claw" configuration seal 48 projects downwardly from the underside of the deck 40 to seal against the annular top surface of the container neck 24. Other conventional or special seal members could instead be provided to extend downwardly from the underside of the closure body deck 40. Such a seal member could be a conventional "V" seal, or some other such conventional or special seal, depending upon the particular application.

Figure 4:
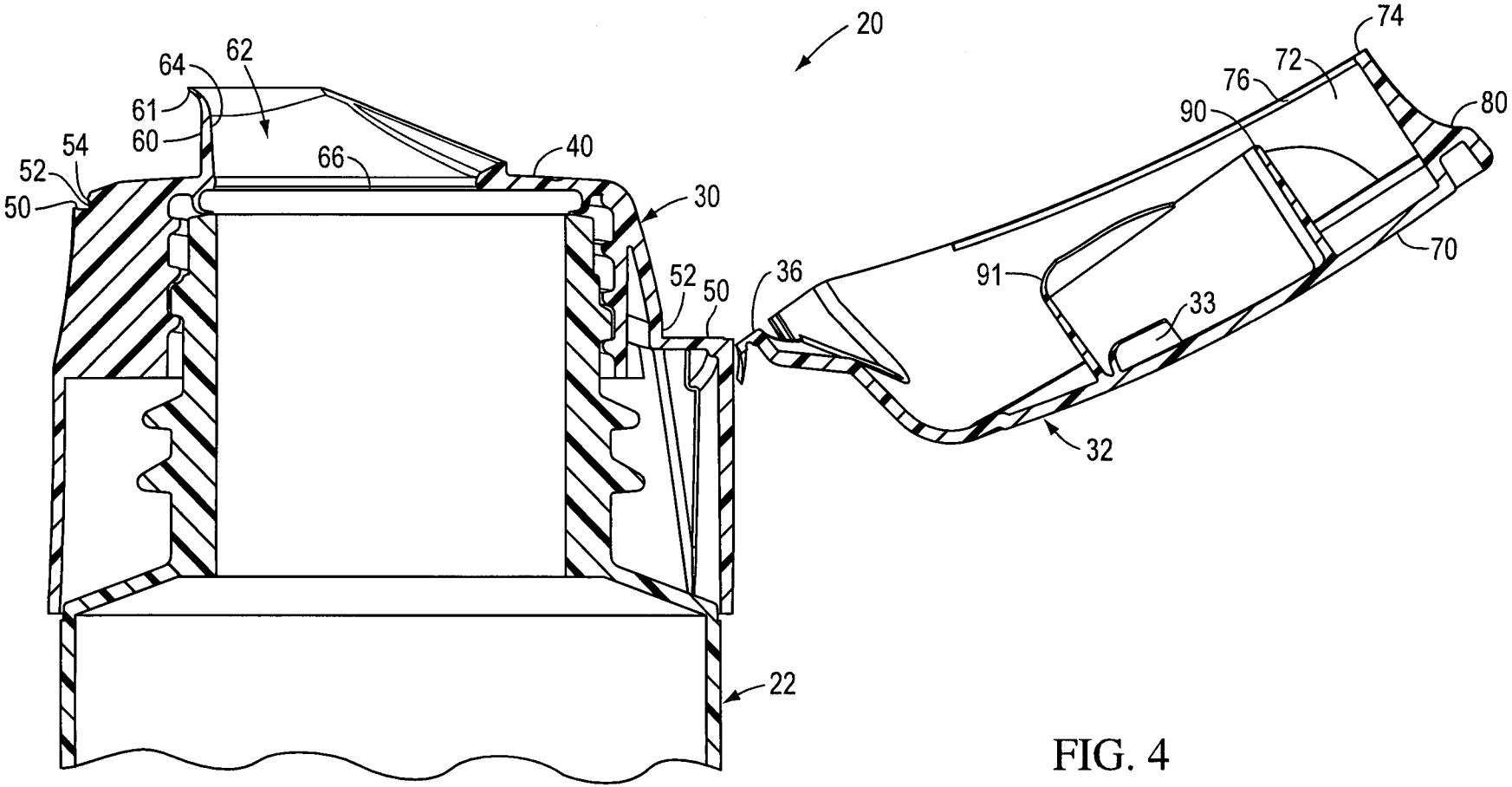
FIG. 4 is a fragmentary, cross-sectional view similar to FIG. 3, but in FIG. 4 the lid is shown opened.
Figure 5:
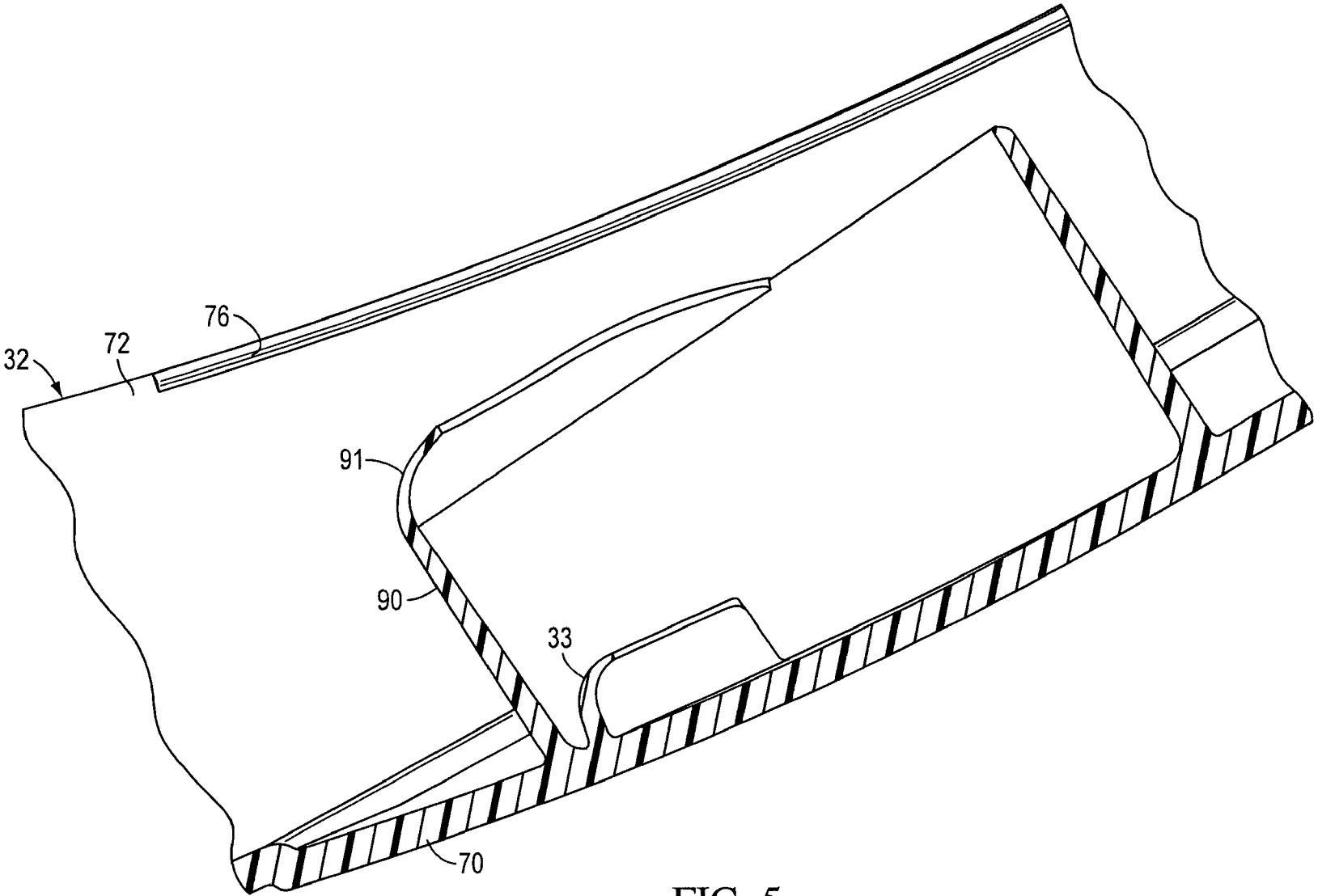
FIG. 5 is a greatly enlarged, fragmentary, cross-sectional view of a portion of the opened closure lid shown in FIG. 4.

As seen in FIGS. 2 and 4, the closure body 30 has an upwardly facing, exterior, peripheral shoulder 50 outwardly of the closure body deck 40, and also has a generally annular neck or wall 52 projecting upwardly from the inner edge of the shoulder 50.

Preferably, as seen in FIGS. 2 and 4, there is a very small, peripheral latch bead 54 located on the periphery of the wall 52 so as to project laterally outwardly from the wall 52 at an elevation above the shoulder 50. However, the latch bead 54 preferably does not extend all the way around the back of the closure body 30 in the region of the hinge 36.

As seen in FIGS. 2 and 4, the closure body 30 has a spout 60 which projects upwardly from the deck 40 and which has a dispensing passage 62 defined at least in part by an interior surface 64 (FIG. 4). At the bottom of the spout interior, a sealing bead 66 (FIG. 4) projects laterally from the interior surface 64. The spout 60 is adapted to be covered by the lid 32.

In the preferred form of the invention, the lid 32 is provided to be closed over, and to cover, the upper part of the closure body 30. The lid 32 can be moved to expose the upper part of the closure body 30 to permit dispensing of the product from the container 22. The lid 32 is movable between (1) a closed position over the body 30 (as shown in FIGS. 1 and 3), and (2) an open position (as shown in FIGS. 2 and 4). In the preferred embodiment illustrated, the lid 32 is hinged to the closure body 30 by means of the hinge 36 so as to accommodate pivoting movement of the lid 32 between the closed position and the open position.

As seen in FIG. 2, the lid 32 includes a top end wall or cover 70 substantially surrounded by a peripheral flange 72. In the illustrated embodiment, the closure hinge 36 is molded unitary with the lid flange 72 and with the closure body 30 so as to accommodate movement of the lid 32 between the open position exposing the closure spout dispensing passage 62, and the closed position occluding the closure spout dispensing passage 62. The hinge 36 may be of any suitable conventional or special design. The hinge 36 illustrated in the figures may be a conventional snap-action type such as described in the U.S. Pat. No. 5,356,017. The hinge could also be a non-snap-action type, including a strap or tether. In yet other embodiments, the hinge could also be a conventional two-piece hinge, such as a clip hinge, in which an axle detail could be provided on the lid 32 and a socket to receive that axle could be provided on the closure body 30.

As seen in FIG. 2, the lid flange 72 has an end surface 74 for being received on, and abutting, the closure body shoulder 50 when the lid 32 is closed (FIG. 3). The lower portion of the lid flange 72 may optionally include an inwardly projecting latch bead 76 (FIG. 2).

A finger tab or thumb tab 80 (FIGS. 3 and 4) may optionally be provided to project laterally outwardly at the front of the closure lid 32. When the lid 32 is closed on the closure body 30, the upwardly facing surface of the lid latch bead 76 is below, and is adapted to engage, the downwardly facing surface of the overlying closure body latch bead 54. The closure body wall 52 and/or the lid flange 72 are sufficiently flexible to accommodate temporary, elastic, deformation as the beads 54 and 76 move past each other during the opening and closing actions. To open the lid 32, the user initially pushes with a thumb or finger upwardly on the bottom of the tab 80. Other conventional or special latch designs could be used instead. In some applications, there may be no need for a latch system at all (especially if the hinge 36 is of the "snap-action" type and has a very strong biasing force).

The lid 32 includes a hollow spud 90 (FIGS. 2 and 3) for entering into the dispensing passage 62 of the closure body spout 60 when the lid 32 is closed. The spud 90 extends from lid wall 70. In the preferred embodiment, the closure body spout 60 and the spud 90 each have configurations accommodating mating engagement when the lid 32 is closed, such as via sealing engagement of the spud 90 with the spout seal bead 66 (as seen in FIG. 4).

The configuration of the spout 60 facilitates the pouring of fluent material from the spout 60 when the lid 32 is opened. By sealingly engaging the spout 60, such as through circumferential contact with the spout seal bead 66 or via other modes of contact, the spud 90 can act to contain the movement of fluent materials within the inside of the spud 90 when the lid 32 is closed; thereby mitigating or avoiding undesired movement of fluent materials about the underside of the lid 32, and/or leakage of fluent materials between the closure body 30 and the lid 32.

For example, the spout 60 is configured to be narrower at its front side (i.e. the side furthest from the hinge 36) relative to other sides thereof, promoting the formation of a controlled stream of fluent material when the container 22 is tipped towards the front side of the closure 30 to pour fluent material through the dispensing passage 62. The spout 60 also includes a flared lip 61, which curves laterally outwards from the upper edge of the front side of the spout 60, further promoting the formation of a controlled stream of fluent material when poured through dispensing passage 62.

In the illustrated embodiment, the removable engagement of the lid spud 90 with the spout seal bead 66 is facilitated by the reduction in elevation of the spout 60 relative to the closure deck 40 at portions of the spout 60 nearest the hinge 36, thereby providing clearance for the pivoting insertion of the spud 90 into the dispensing passage 62.

When the lid 32 is in a closed position, the container 22 may be subjected to movement that causes materials within the container 22, such as liquids, to splash upwards, through the dispensing passage 62 and onto the interior surfaces of the spud 90. For example, the container 22 may be utilized to contain mixtures, such as coffee creamer or other food products, whereby a consumer may desire to shake the container 22 prior to dispensing the contained product, in order to better mix the product. Alternatively, the container 22 may be subject to movement during transportation which results in splashing of contained product. In either case, droplets of such products may accumulate on the spud interior.

In conventional spud and spout closures wherein product droplets accumulate on the interior surfaces of the hollow spud, when the lid is subsequently opened and the container is tilted in order to pour contained materials through the dispensing passage, such accumulated droplets may travel along the interior surfaces of the spud, and ultimately-drip or leak off of the spud, resulting in undesired accumulation of product on the closure top deck, and/or uncontrolled dripping of product into the environment surrounding the container.

However, the closure 22 in the illustrated embodiment includes features that may serve to reduce or eliminate the dripping of product accumulated on the interior of the spud 90, while the lid 32 is in an opened state. For example, the spud 90 includes a spud rim 91. Rims such as the spud rim 91 are sometimes referred to as "drip catchers." In the preferred embodiment, the spud rim 91 is formed at the distal end of the spud 90, and has a curved cross-section which extends laterally towards the interior of the spud 90. However, it is contemplated that spud rims having non-curved cross-sectional configurations can also be employed. It is further contemplated, although not preferred, that the spud rim 91 could be located at portions of the spud 90 other than the distal end, such as a position midway between the distal and proximal ends of the spud 90.

Preferably, the spud rim 91 extends along a portion of the periphery or circumference of the spud 90 that is nearest to the hinge 36, which is the direction in which the upper portion of container 22 will typically be tilted in order to dispense the contents of the container 22 from the spout 60. When the opened container 22 is tilted to dispense product from the spout 60 (FIG. 6), the spud rim 91 can serve to catch a droplet 100 of product or material that has accumulated on the interior of the spud 90, thereby preventing the droplet 100 from falling out onto the closure top deck 40 or into the surrounding environment.

The spud rim 91 may provide other benefits in addition to controlling the movement of product accumulated on the interior of the spud 90. For example, the spud rim 91 may serve to increase the rigidity of the walls of the spud 90. Moreover, the curved outer surface of the spud rim 91 may promote the alignment of the spud 90 with the spout 60 during the process of closing the lid 32 onto the closure body 30.

In some applications, it may be desirable to provide two or more rims, in order to further control the movement of droplets that may be formed within the spud 90, such as an additional rim which may be positioned near the base of the spud 90. The presently preferred embodiment of the closure 22 features a second rim 33, which extends from the inside surface of lid top end wall 70. Like the first rim or spud rim 91, the illustrated embodiment of the second rim or lid rim 33 has a curved cross-section, although it is understood that non-curved cross-sections could also be employed. The length of the lid rim 33 is generally uniformly spaced from, or parallel to, a portion of the spud 90. The lid rim 33 extends outward from the interior surface of the lid top end wall 70 from a location proximate to a portion of the inside perimeter of the spud 90 that is oriented towards the hinge 36. The lid rim 33 curves inwardly toward the center portion of the hollow interior of the spud 90.

Figure 6:
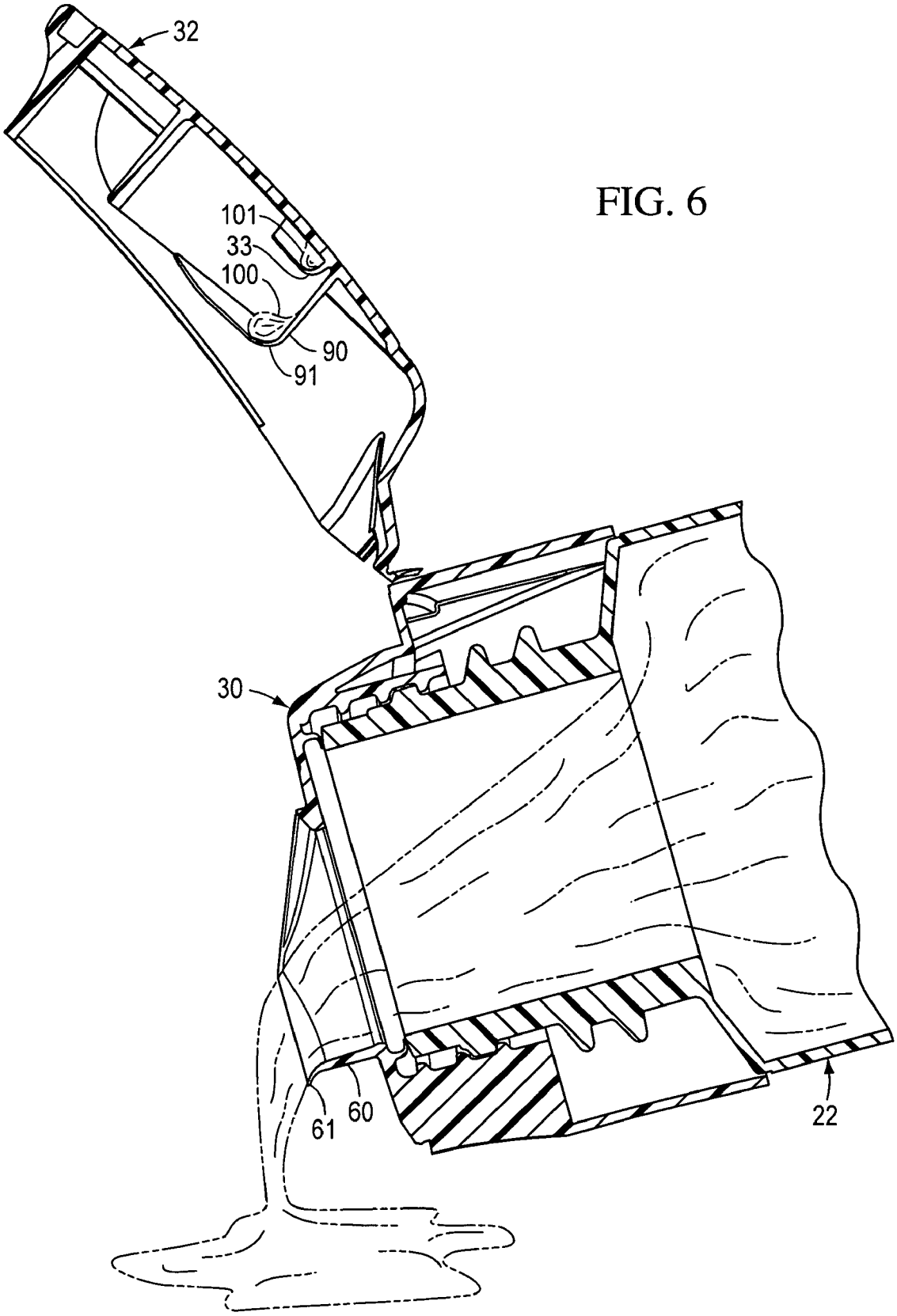
FIG. 6 is a fragmentary view similar to FIG. 4, but in FIG. 6 the package (comprising the container, product, and lid) is shown tipped to dispense the product.

Like the spud rim 91, the lid rim 33 can serve to catch droplets of product or material that have accumulated on the interior of the spud 90, such as droplet 101 in FIG. 6, thereby preventing droplet 101 from falling out onto the closure top deck 40 or into the surrounding environment. The positioning of the lid rim 33 relative to the top end wall 70 and/or the spud 90 may also act to improve the capacity of lid rim 33 to retain the fluent material by, for example, providing increased surface area and locations at which the fluent material can be retained.

According to one broad aspect of some embodiments of the present invention, the lid rim 33 alone may be employed without any spud rim (e.g., rim 91). Accordingly to another broad aspect of some embodiments of the invention, the spud rim 91 alone may be employed without any lid rim (e.g. rim 33). While the spud rim 91 and the lid rim 33 may be beneficially employed in the alternative, embodiments employing both of the spud rim 91 and the lid rim 33 may be particularly effective in controlling or avoiding the undesired or uncontrolled dissemination of materials accumulating on the interior of the spud 90.

Embodiments of the invention such as the illustrated embodiment may be particularly advantageous, in that the facilities to manufacture the closure 22 can be readily tooled. In particular, the manufacture of the illustrated embodiment of the closure 22 can be accomplished without the use of lifters or other complicated tool actions.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing closure for a container that has an opening to the container interior where a fluent substance may be stored, said dispensing closure comprising:

(A) a body for extending from said container at said container opening, said body including a spout that has a dispensing passage extending through said spout; and (B) a lid for movement between (1) a closed position occluding said spout dispensing passage, and (2) an open position exposing said spout dispensing passage, said lid having a spud for entering said spout dispensing passage when said lid is in said closed position, said spud having a hollow interior, said spud further having a spud rim unitary with said spud and extending laterally from said spud, said lid further having a lid rim proximate said spud extending axially away from said lid and laterally toward said hollow interior, and said lid rim being located within said hollow interior of said spud and extending laterally toward the center of said hollow interior of said spud.

2. The dispensing closure in accordance with claim 1 in which said spud has a distal end, and said spud rim is formed at the distal end of said spud.

3. The dispensing closure in accordance with claim 1 in which said spud rim curves laterally toward said hollow interior.

4. The dispensing closure in accordance with claim 1 in which said lid is attached to said body via a hinge; and said spud rim is positioned along a portion of said spud that is proximate said hinge.

5. A dispensing closure for a container that has an opening to the container interior where a fluent substance may be stored, said dispensing closure comprising:

(A) a body for extending from said container at said container opening, said body including a spout that has a dispensing passage extending through said spout; and (B) a lid for movement between (1) a closed position occluding said spout dispensing passage, and (2) an open position exposing said spout dispensing passage, said lid having a spud for entering said spout dispensing passage when said lid is in said closed position, said spud having a hollow interior, said lid further having a lid rim proximate said spud extending axially away from said lid and laterally toward said hollow interior, said lid rim being located within said hollow interior of said spud and extending laterally toward the center of said hollow interior of said spud, said lid further having a top end defining an inside surface, said lid rim projecting from said inside surface of said lid, and said lid rim further being proximate to, and uniformly spaced from, a portion of the inner surface of said spud.

6. A dispensing closure for a container that has an opening to the container interior where a fluent substance may be stored, said dispensing closure comprising:

(A) a body for extending from said container at said container opening, said body including a spout that has a dispensing passage extending through said spout; and (B) a lid for movement between (1) a closed position occluding said spout dispensing passage, and (2) an open position exposing said spout dispensing passage, said lid having a spud for entering said spout dispensing passage when said lid is in said closed position, said spud having a hollow interior, said lid further having a lid rim proximate said spud extending axially away from said lid and laterally toward said hollow interior, said lid rim being located within said hollow interior of said spud and extending laterally toward the center of said hollow interior of said spud, said lid further having a top end defining an inside surface, said lid rim projecting from said inside surface of said lid, said lid further being attached to said body via a hinge, and said lid rim being proximate to, and uniformly spaced from, a portion of the inner surface of said spud which is oriented towards said hinge.

* * * * *